US006626746B2

(12) United States Patent
Mayr et al.

(10) Patent No.: US 6,626,746 B2
(45) Date of Patent: Sep. 30, 2003

(54) SANDER WITH A CLAMPING DEVICE

(75) Inventors: Franz-Paul Mayr, Ilechenwang (DE); Olaf Bode, Ulting (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 09/951,708

(22) Filed: Sep. 14, 2001

(65) Prior Publication Data

US 2002/0037691 A1 Mar. 28, 2002

(30) Foreign Application Priority Data

Sep. 18, 2000 (DE) ..... 100 46 065

(51) Int. Cl.[7] ..... B24B 23/00

(52) U.S. Cl. ..... 451/356; 451/344; 451/354; 451/514

(58) Field of Search ..... 451/344, 354, 451/356, 514, 520, 523, 499, 490

(56) References Cited

U.S. PATENT DOCUMENTS

| | | | | |
|---|---|---|---|---|
| 672,408 A | | 4/1901 | McAfee | |
| 2,334,173 A | | 11/1943 | Champayne | |
| 2,475,476 A | | 7/1949 | Champayne | |
| 4,077,165 A | | 3/1978 | Hutchins | |
| 4,216,631 A | | 8/1980 | Ryer | |
| 4,475,317 A | * | 10/1984 | Dicke | 451/356 |
| 4,625,462 A | * | 12/1986 | Fushiya et al. | 451/357 |
| 5,309,681 A | * | 5/1994 | Cheney et al. | 451/344 |
| 5,417,737 A | * | 5/1995 | Young | 564/63 |
| 5,616,072 A | * | 4/1997 | Walz et al. | 451/356 |

FOREIGN PATENT DOCUMENTS

| | | |
|---|---|---|
| SE | 0138229 | 6/1950 |

* cited by examiner

*Primary Examiner*—Joseph J. Hail, III
*Assistant Examiner*—Alvin J Grant
(74) *Attorney, Agent, or Firm*—Sidley Austin Brown & Wood, LLP

(57) ABSTRACT

A manually operated sander including a motor-driven grinding plate for treating a workpiece, and a device (2) for releasably clamping abrasive paper to the grinding plate, with the clamping device (2) having a clamping surface element (9) and a clamping stirrup (11) eccentrically pivotable with respect to the clamping surface element (9) for securing at least one end region (16) of the abrasive paper (3), with a gap (S) between a pivotal path (B) of the clamping stirrup (11) and the clamping surface element (9) substantially closing toward a region of the clamping surface element (9) that cooperates with the clamping stirrup (11) for clamping the at least one end region (16) of the abrasive paper (3).

9 Claims, 2 Drawing Sheets

Fig. 1
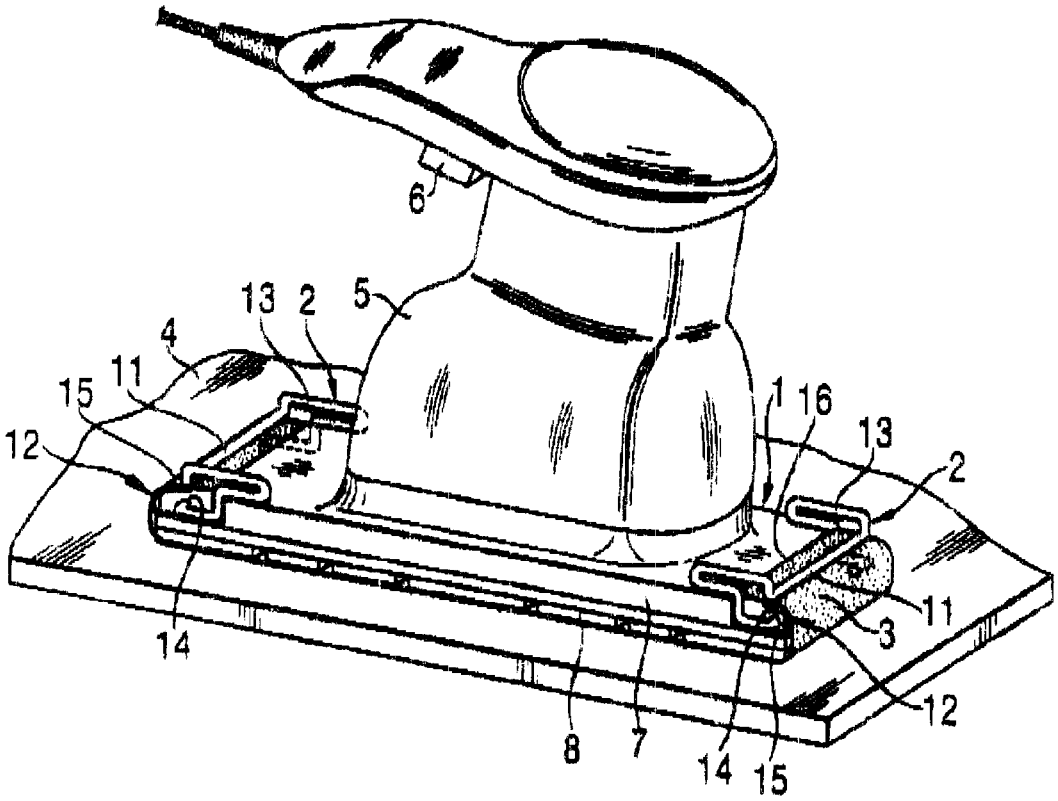
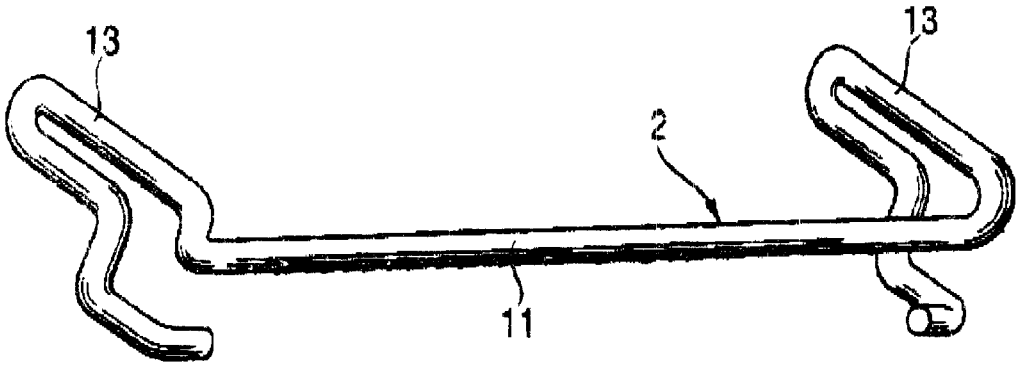
Fig. 2

SANDER WITH A CLAMPING DEVICE

BACKGROUND OF THE INVENTION

1. Field of the Invention

The present invention relates to an electrical tool, and, in particular, to a manually operated sander such as an orbital sander or the like including a motor-driven grinding plate adjacent to a workpiece, and a device for releasably clamping the abrasive paper to the grinding plate, with the clamping device having a clamping surface element for securing at least one end region of the abrasive paper.

2. Description of the Prior Art

In a sander of the type described above, the grinding plate is driven by an electric motor which oscillates the grinding plate over the workpiece. An abrasive paper, which is secured to the bottom of the grinding plate with the clamping device, removes, as a result of the oscillating movement of the grinding plate, the material from the surface of the workpiece. The service life of the abrasive paper depends on the material of the workpiece and prevailing basic condition. After the expiration of the service life of the abrasive paper, the worn-out paper should be replaced with a new one. For replacing the worn-out abrasive paper, the clamping device, which is provided on the upper surface of the grinding plate is actuated in order to release the worn-out abrasive paper and to provide for its replacement. Then, the clamping device clamps the new abrasive paper to the grinding plate. In the clamping condition of the new abrasive paper, at least the end region of the abrasive paper is located in the clamping device in the clamping condition of the abrasive paper. A concave clamping surface of the clamping device forms a bearing surface for the clamping section of the abrasive paper.

An orbital sander of the above-described type is disclosed in German Publication DE 198 00 04 A1. The known sander includes a grinding plate and a clamping device for securing an abrasive paper to the grinding plate. The clamping device has a clamping surface that cooperates with a roll-shaped, elastic clamping stirrup. At least one end region of the abrasive paper is introduced between the clamping stirrup and the clamping surface and is clamped therebetween. The necessary clamping force is achieved by clamping the clamping stirrup against the clamping surface.

The arrangement disclosed in DE 198 00 044 A1 permits to satisfactory secure the abrasive paper to the grinding plate with the clamping device. However, the drawback of the arrangement of DE 198 00 044 A1 consists in that the abrasive paper, while being adequately clamped by the clamping device, is not tensioned. As a result, the quality of grinding as well as the service life of the abrasive paper are reduced. The reduction in the service life necessitates often replacement of the abrasive paper. Alternatively, additional time may be required for tensioning of the abrasive paper when the known clamping device is used.

Further, the use of abrasive papers having different thicknesses and graining makes the handling of the sander more difficult and, in particular, the handling of the clamping device with which different operational forces need be applied, as there is no possibility to regulate the pressure force.

Moreover, the resiliency of the clamping stirrup is subjected to changes which results in changes of the pressing force applied thereby. The user of the sander has no means available for compensating the pressing force changes and which permits to avoid the changes of the pressing force.

Accordingly, an object of the present invention is to provide a sander with a clamping device which would insure a reliable clamping of the abrasive paper and, simultaneously, tensioning of the abrasive paper.

Another object of the present invention is to provide a sander with clamping device which would insure easy handling even when abrasive papers having different thicknesses are used.

A further object of the present invention is to provide a sander with a clamping device which can be economically produced.

SUMMARY Of THE INVENTION

This and other objects of the present invention, which will become apparent hereinafter, are achieved by providing a clamping device with a clamping stirrup eccentrically pivotable with respect to the clamping surface element, with a gap between a pivotal path of the clamping stirrup and the clamping surface element substantially closing toward a region of the clamping surface element that cooperates with the claiming stirrup for clamping the end region of the abrasive paper to the grinding plate.

The pivotal arrangement of the clamping stirrup and a gap between the clamping surface and the clamping stirrup, the width of which is gradually reduced, permit to obtain a clamping force that would provide for at least clamping of the end region of the abrasive paper. Further, the invention facilitates the use of abrasive papers having different thicknesses.

Moreover, the foregoing novel features of the present invention provide for compensation of changes in the clamping characteristics of the clamping device. Still further, the pivotal arrangement of the clamping stirrup and the gap between the clamping surface and the stirrup permit to increase tolerances of the parts of the clamping device, which reduces the production costs. Overall, the present invention provides a sander and, in particular, a clamping device that is very easy to handle.

Advantageously, the clamping stirrup has a circular pivotal path. The circular pivotal path insures an easy conversion of the clamping device and, in particular, positioning of the clamping stirrup. With the clamping stirrup being pivotally supported on the grinding plate, it can be easily guided. The clamping device can be easily operated with one hand. This significantly facilitates handling of the entire sander.

Advantageously, the pivotal angle, which is described by the clamping stirrup upon its pivotal movement into the clamping position, amounts to at least 45°, preferably, to about 90°. A wide pivotal region provides for a greater clamping path. A greater or longer clamping path insures an optimal tensioning or tightening of the used abrasive paper and reduces expenditure of forces necessary for clamping of the abrasive paper.

According to a preferred embodiment of the present invention, the clamping surface is formed as a circular or arcuate surface which further simplifies the manufacturing process, making it more economical.

To provide for a simple insertion of the abrasive paper, the clamping surface element preferably is provided in a region of an edge of the grinding plate remote from the workpiece. With such an arrangement of the clamping surface element (s), the abrasive paper becomes pressed against a side of the grinding plate adjacent to the workpiece, with one or both end region(s) of the abrasive paper being clamped between the clamping surface element(s) and the clamping stirrup(s). All this further facilitates handling of the sander. Naturally, the clamping device can be provided at another location of the grinding plate.

In the preferred embodiment of the sander according to the present invention, the clamping means includes two clamping devices each having a clamping surface element and a clamping stirrup which are provided at two opposite, remote from the workpiece, edges of the grinding plate.

Two U-shaped spring members, which are advantageously provided at opposite ends of the clamping stirrup, prevent the clamping force from exceeding a predetermined threshold value. The provision of the spring members also permits to increase the tolerance range of the sander parts during manufacturing of the clamping device.

To insure a cost-effective manufacturing of the clamping device, the clamping stirrup and the spring members are formed as a one-piece part made of wire.

Advantageously, the clamping surface element is formed of a sheet metal or of any other hard material in order to insure optimal sliding of the abrasive paper over the clamping surface. This insures optimal tensioning of the abrasive paper because the abrasive paper slides well over the hard surface, whereby it is insured that the abrasive paper firmly abuts the side of the grinding plate adjacent to the workpiece.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

BRIEF DESCRIPTION OF THE DRAWINGS

The drawings show:

FIG. 1 a perspective view of an electrical tool according to the present invention;

FIG. 2 a perspective view of the clamping stirrup shown in FIG. 1;

DETAILED DESCRIPTION OF THE PREFERRED EMBODIMENT

Figure 3:
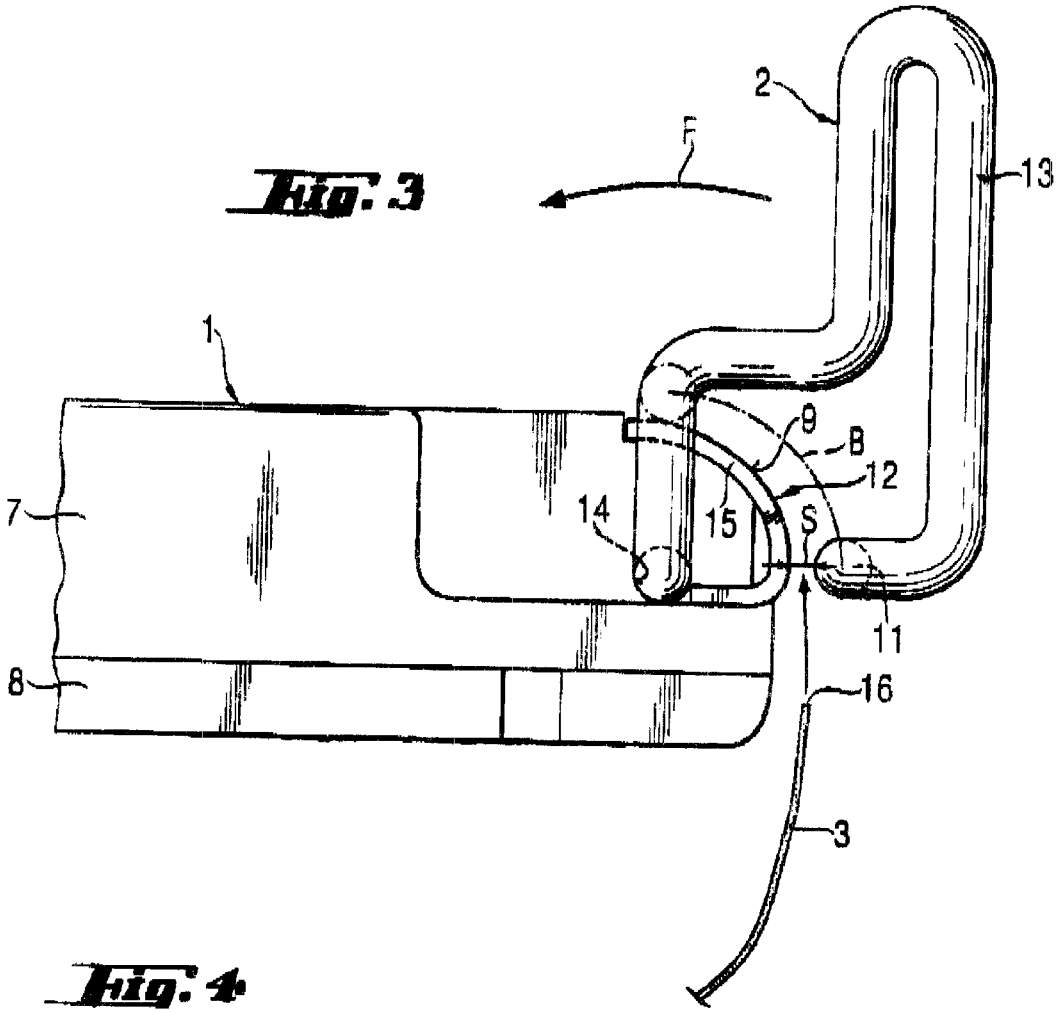
FIG. 3. a side view of the electrical tool in a region of the clamping device in a release condition of the clamping device.
Figure 4:
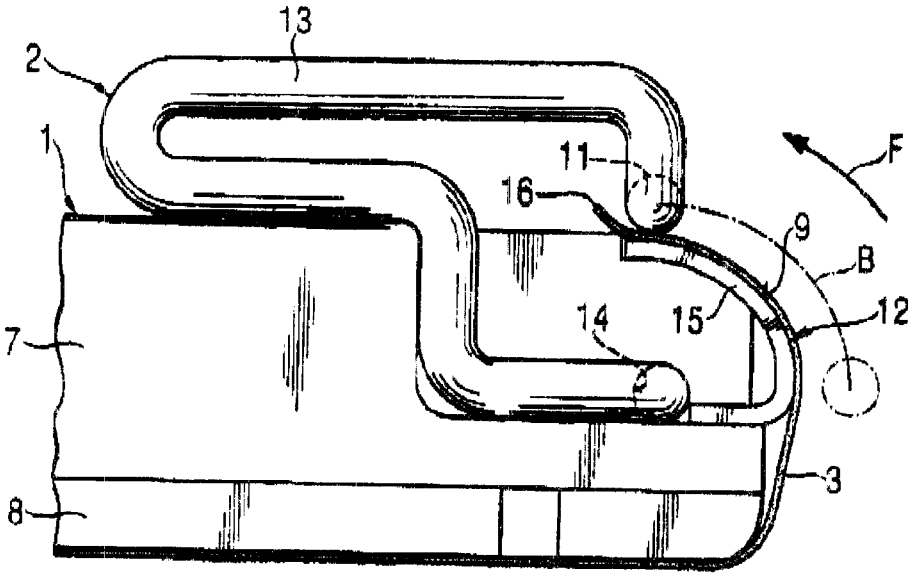
FIG. 4. a side view of the electrical tool in the region of the clamping device in the clamping position of the clamping device.

An electrical power tool according to the present invention, in particular, a manually operated, orbital sander, which is shown in FIGS. 1 through 4, has a rectangular grinding plate 1 provided with an abrasive paper 3 secured to the plate 1 with a clamping device 2.

The grinding plate 1 is displaceably secured to a tool housing 5 and is displaced by an electric motor (not shown) located in the housing 5. For turning the electric motor on and off, the housing 5 is provided with a switch 6.

The grinding plate 1 includes an upper plate 7 resistant to bending and remote from the workpiece 4, and a bottom, non-rigid plate 8. Both plates 7 and 8 can be clearly seen in FIGS. 3–4. The bottom plate 8 serves for guiding the abrasive paper 3 which contacts the workpiece 4 and is secured on the grinding plate 1 with the clamping device 2.

The clamping device 2 has a clamping surface element 9 and a clamping stirrup 11 which is arranged in a region of an edge 12 of the plate 1 remote from the workpiece 4 and which extends transverse to the upper plate 7. A U-shaped spring member 13 adjoins the rectilinear clamping stirrup 11 at each of its opposite ends. The stirrup 11 and both spring members 13 are formed as a one-piece wire stirrup which is pivotally supported in the upper plate 7 which is provided to this end with respective bores 14. The arcuate clamping surface element 9, which extends transverse to the grinding plate 1, is formed by a sheet 15 extending parallel to the clamping stirrup 11. The sheet 15 can be, e.g., screwed down to the grinding plate. The clamping stirrup 11 can pivot along a circular path B about an axis that is formed by a line connecting the two bores 14. The rotational axis of the stirrup 11 extends eccentrically with respect to the clamping surface element 9 of the clamping sheet 15, 50 that in the release position of the clamping device 2, as shown in FIG. 3, the end region 16 of the abrasive paper 3 can be introduced between the clamping surface elements 9 and the stirrup 11.

Upon the pivotal movement of the stirrup 11 along the circular path B, the stirrup 11 and the clamp surface elements 9 approach each other. Therefore, the pivotal movement of the stirrup 11 toward a side of the upper plate 7 remote from the workpiece 4 in the clamping direction F leads to the clamping of the end region 16 of the abrasive paper 3 as a result of reduction of the gap S between the clamping stirrup 11 and clamping surface element 9 formed by the sheet 15. The spring members 13 prevent a clamping force, which is applied to the adhesive paper 3 by the stirrup 11, from passing over to the clamping surface element 9. For releasing the adhesive paper 3, the clamping stirrup 11 is pivoted in a direction opposite to the clamping direction F, which results in an increase of the gap S between the clamping surface element 9 and the clamping stirrup 11. In this position of the clamping stirrup 11, the abrasive paper 3 can be replaced.

Though the present invention was shown and described with references to the preferred embodiment, such are merely illustrative of the present invention and are not to be construed as a limitation thereof, and various modifications of the present invention will be apparent to those skilled in the art. It is, therefore, not intended that the present invention be limited to the disclosed embodiments or details thereof, and the present invention includes all variations and/or alternative embodiment within the spirit and scope of the present invention as defined by the appended claims.

What is claimed is:

1. A manually operated sander, comprising a motor-driven grinding plate (1) for treating a workpiece (4); an abrasive paper (3) provided on a side of the grinding plate (1) adjacent to the workpiece (4); and a device (2) for releasably clamping the abrasive paper (3) to the grinding plate (1), the clamping device (2) having an arcuate clamping surface element (9) for supporting at least one end (16) of the abrasive paper (3) and securable to the grinding plate (1), and a clamping stirrup (11) eccentrically pivotable with respect to the arcuate clamping surface element (9) along an arcuate path (B), an arcuate extent of which substantially corresponds to an arcuate extent of the arcuate clamping surface element (9), for securing the at least one end region (16) of the abrasive paper (3) to the grinding plate (1), wherein a gap (S) between the pivotal arcuate path (B) of the clamping stirrup (11) and the arcuate clamping surface element (9) substantially closes toward a region of the clamping surface element (9) that cooperates with the clamping stirrup (11) for clamping the at least one end region (16) of the abrasive paper (3) therebetween.

2. A sander according to claim 1, wherein the pivotal path (B) of the clamping stirrup (11) is a circular path.

3. A sander according to claim 2, wherein a pivotal angle, which is described by the clamping stirrup (11) upon a pivotal movement thereof into a clamping position, amounts to about at least 45°.

4. A sander according to claim 3, wherein the pivotal angle amounts to about 90°.

5. A sander according to claim 1, wherein the clamping surface element (9) has an arcuate profile.

6. A sander according to claim 1, wherein the clamping surface element (9) is provided at an edge of the grinding plate (1) remote from the workpiece (4).

7. A sander according to claim 1, wherein the clamping device (2) has two U-shaped spring members (13) provided, respectively, at opposite ends of the clamping stirrup (11).

8. A sander according to claim 7, wherein the clamping stirrup (11) and the spring members (13) are formed as a one-piece part made of wire.

9. A sander according to claim 1, wherein the clamping surface element (9) is formed of sheet metal.

* * * * *